US006779666B2

(12) United States Patent
Collins

(10) Patent No.: US 6,779,666 B2
(45) Date of Patent: Aug. 24, 2004

(54) PACKAGING ENVELOPE AND METHOD FOR MAKING THE SAME

(75) Inventor: Robert W. Collins, Shawnee, KS (US)

(73) Assignee: Winkler + Dunnebier, AG (DE)

( * ) Notice: Subject to any disclaimer, the term of this patent is extended or adjusted under 35 U.S.C. 154(b) by 77 days.

(21) Appl. No.: 09/925,440

(22) Filed: Aug. 9, 2001

(65) Prior Publication Data

US 2003/0029767 A1 Feb. 13, 2003

(51) Int. Cl.[7] ..... B65D 25/02
(52) U.S. Cl. ..... 206/594; 206/784; 229/87.02
(58) Field of Search ..... 206/521, 591, 206/594, 522, 523, 784; 383/35; 729/92.8, 87.02, 92

(56) References Cited

U.S. PATENT DOCUMENTS 1,126,341 A * 1/1915 Baer ..... 383/121
3,660,195 A 5/1972 Hoyt
4,241,829 A * 12/1980 Hardy ..... 206/709
4,278,624 A 7/1981 Kornylak
4,580,683 A * 4/1986 Gochenour ..... 383/205
4,679,688 A * 7/1987 Soderholm et al. ..... 206/204
4,938,360 A * 7/1990 Wallace ..... 206/586
5,167,454 A * 12/1992 Woods et al. ..... 383/35
5,525,639 A 6/1996 Keneko et al.
5,635,543 A 6/1997 Kaneko et al.
5,692,607 A * 12/1997 Brosmith et al. ..... 206/308.1
5,954,203 A * 9/1999 Marconi ..... 206/464

* cited by examiner

*Primary Examiner*—Jacob K. Ackun, Jr.
(74) *Attorney, Agent, or Firm*—Shook, Hardy & Bacon L.L.P.

(57) ABSTRACT

An envelope, bag or other mailing device for preventing the shifting of an item located within the envelope and a method for making the same is provided. The envelope includes a front panel, a back panel and at least one protrusion. The back panel is coupled to the front panel to form an interior portion formed between opposed interior surfaces of the front and back panels. The protrusion is coupled to one of the opposed interior surfaces and extends into the interior portion of the envelope. In another embodiment, a second protrusion is coupled to the other side of opposed interior surfaces and extends into the interior portion of the envelope. The protrusions are adapted tp associate with one another to protect items contained within the envelope from external forces and prevent the item from moving around within the interior portion of the envelope.

1 Claim, 2 Drawing Sheets

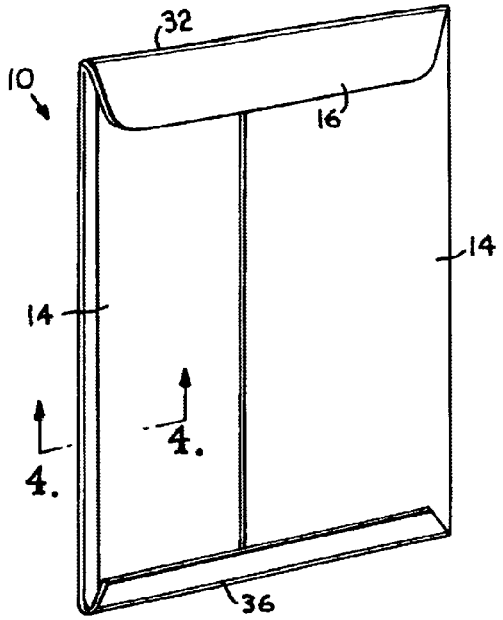
FIG. 1.
FIG. 4.
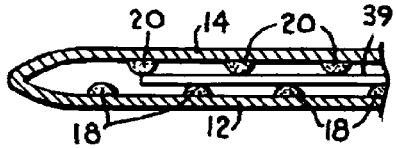
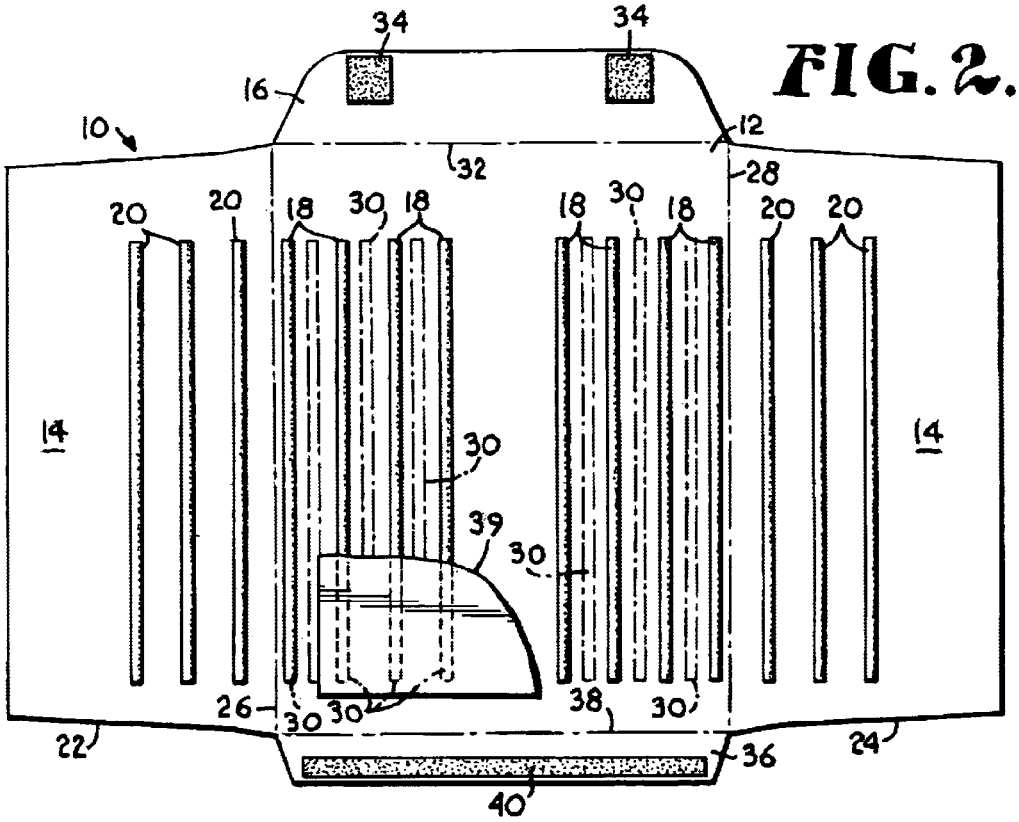
FIG. 2.
FIG. 3.
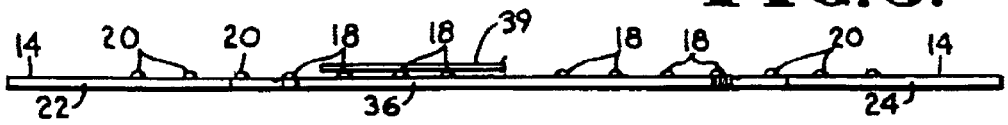

FIG. 5.
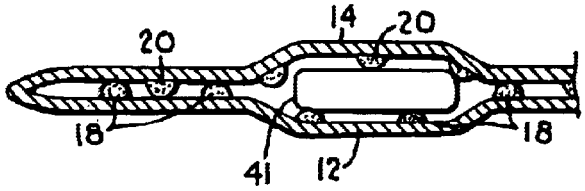
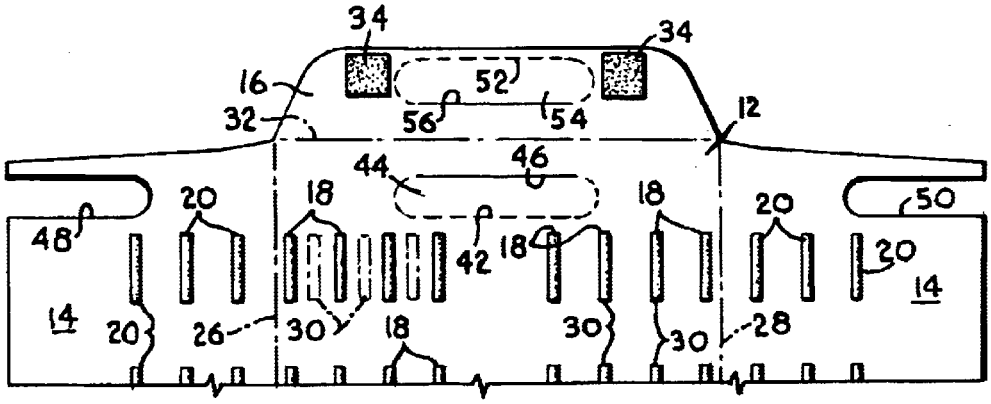
FIG. 6.
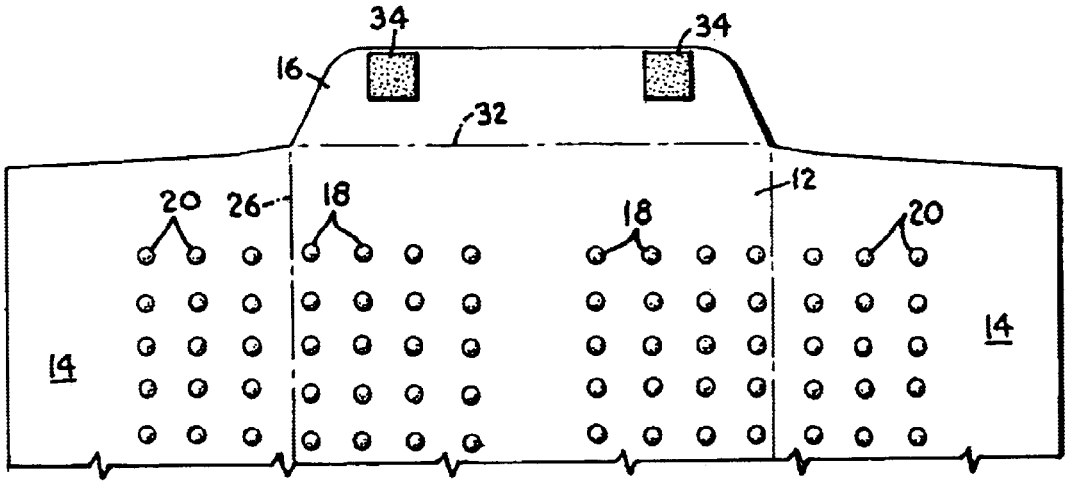
FIG. 7.

PACKAGING ENVELOPE AND METHOD FOR MAKING THE SAME

STATEMENT REGARDING FEDERALLY SPONSORED RESEARCH OR DEVELOPMENT

Not Applicable.

CROSS-REFERENCE TO RELATED APPLICATIONS

Not Applicable.

FIELD OF INVENTION

This invention relates to a packaging envelope. More particularly, this invention relates to a packaging envelope which provides padding to protect the contents, and also prevents contents from sliding within the interior portion of the envelope.

BACKGROUND OF INVENTION

There are many types of envelopes that can be used to mail an item. Commonly an envelope has some type of bubble pack or padding lined on the interior portion of an envelope to protect the contents from being damaged.

Prior art packaging envelopes suffer from a number of drawbacks and deficiencies. For example, the bubble or packing material creates a smooth surface lining the interior portion of the envelope, allowing items to slide within the envelope. Sliding of the contents may cause damage as the items shift and rub against one another. Although the bubble packs and padding provide protection from damage due to exterior forces often present during mailing, there is nothing to prevent an item from being damaged within the envelope or to prevent two or more items within the envelope from causing damage to each other.

Another deficiency associated with prior art packaging is the expense of manufacturing padded or bubble pack type envelopes. This expense is often incurred in the extra materials required to provide the protection, such as the padding or bubble pack materials. Additional expense can also be incurred due to slower manufacturing times. For instance, creating and affixing the bubble pack material or other types of padding can typically not be done in a single step during the envelope formation process. Therefore, the use of bubble pack or other types of padding material can slow down the speed of the envelope forming process.

Accordingly, there remains a need for an envelope that reduces damage to the contents of an envelope by preventing items from shifting within the interior of the envelope. In addition, there remains a need for a packaging envelope that adequately protects items contained within the envelope during handling while preventing those items from shifting within the interior of the envelope. There further remains a need for providing a packaging envelope which can be inexpensively produced.

SUMMARY OF THE INVENTION

Accordingly, in one of its aspects, the present invention provides an envelope for packaging an item.

In another of its aspects, the present invention provides an envelope for packaging an item and preventing that item from shifting within the interior of the envelope.

In still another of its aspects, the present invention provides a method and envelope for reducing the movement of an item contained within the envelope.

In yet another of its aspects, the present invention provides a relatively inexpensive method of providing protective packaging envelopes.

According to the present invention, the foregoing and other aspects are achieved by an envelope for packaging an item, the envelope comprising a front panel, a back panel and at least two protrusions. The back panel is coupled to the front panel to form an interior portion. One of said protrusions is coupled to the interior surface of the front panel, and is positioned in the interior portion of the envelope. Another protrusion is coupled to the back panel, and is positioned in the interior portion of the envelope.

The present invention also provides for an envelope, bag or other mailing device for packaging an item, the envelope comprising a front panel, a back panel and at least one first protrusion. The back panel is coupled to the front panel to form an interior portion. The interior portion being defined by opposed interior surfaces of said front and back panels. The first protrusion is coupled to one of the opposed interior surfaces and extends from said opposed interior surface into the interior portion of the envelope.

The present invention further provides an envelope, bag or other mailing device for packaging an article, the envelope comprising a front panel and a back panel. The back panel is coupled to the front panel to form an interior portion. The envelope also includes a means for reducing the movement of the article within said interior portion of the envelope.

The present invention still further provides for a method for making an envelope, the envelope including a front panel, a back panel, at least one protrusion. The front and back panels are adapted to be coupled to one another to form an interior portion within opposed interior surfaces of the front and back panels. The protrusion is adapted to be coupled to one of the opposed surfaces and extends into the interior portion of the envelope. The method includes affixing the first protrusion to one of the opposed surfaces and coupling the front and back panels to form the interior portion and so that the first protrusion extends into the interior portion of the envelope.

Alternatively, the second set of protrusions need not be positioned so as to mesh with the first set of protrusions, but can instead be positioned in any manner desired, including being positioned partially or completely aligned with the first set of protrusions.

Additional objects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means and instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are employed to indicate like parts in the various views:

FIG. 1 is a back perspective view of an envelope having a series of protrusions located within the interior portion in accordance with the preferred embodiment of the present invention;

FIG. 2 is a plan view of a blank for the construction of the envelope of FIG. 1, showing the protrusions positioned on the interior surface of the envelope;

FIG. 3 is a front elevational view of the blank shown in FIG. 2;

FIG. 4 is a fragmentary cross-sectional view taken generally along the line 4—4 of FIG. 1, showing a piece of paper positioned within the interior portion of the envelope;

FIG. 5 is a fragmentary cross-sectional view similar to FIG. 4, showing an object placed in the interior portion of the envelope, and further showing the protrusions meshing with one another;

FIG. 6 is a fragmentary plan view of a blank for the construction of an envelope having a handle formed therein, wherein the protrusions are formed in spaced segments; and FIG. 7 is a fragmentary plan view of a blank for the construction of an envelope, wherein the protrusions are formed as spaced dots.

DETAILED DESCRIPTION OF THE PREFERRED EMBODIMENTS

The present invention is directed to a packaging envelope and a method for making the same. The particular embodiments described herein are intended in all respects to be illustrative rather than restrictive. Alternative embodiments will become apparent to those skilled in the art to which the invention pertains without departing from its scope.

Referring to the drawings in general and initially to FIG. 1 in particular, an exemplary envelope employing principles of the present invention is shown and designated generally by reference numeral 10. In its most basic configuration as shown in FIGS. 1 and 2, envelope 10 is formed of a blank that includes a front panel 12 and a back panel 14. Front panel 12 is coupled to back panel 14 to form an interior portion of the envelope where items may be placed. A seal flap 16 extends from front panel 12 and can be selectively coupled to back panel 14 to close envelope 10 to protect any contents from an external environment. A set of protrusions 18, 20 are coupled to front and back panels 12, 14, respectively, and are used to protect the contents from external forces, and prevent items from shifting within the interior portion of the envelope.

As best seen in FIG. 2, envelope 10 is open-ended style, and is preferably formed of a paper material, but it could be formed of plastic, TYVEC® or any other material that would be suitable for transporting or mailing items contained within envelope 10. It will be understood and appreciated that the present invention is also adapted to be used on any other suitable style envelope including, but not limited to, a booklet-style envelope. Further, the present invention is also adapted to be used, not only on envelopes, but also on suitable bags and other mailing devices.

As best seen in FIGS. 2 and 3, front panel 12 includes a top, bottom, right and left edge, and has an exterior and an interior surface. Protrusions 18 are coupled to front panel 12 and are used in conjunction with protrusions 20 located on back panel 14 to protect and reduce the amount of movement of an item located within the interior portion of envelope 10. Specifically, protrusions 18 are elongated beads of material that are coupled to the interior surface of front panel 12 and protrude outwardly from the interior surface of front panel 12 into an interior portion of envelope 10. Protrusions 18 are spaced apart from one another at a distance that will allow protrusions 20 located on the interior surface of back panel 14 to mesh or fit in between protrusions 18, as seen by the dotted lines 30. Further, protrusions 18 generally extend in a direction that is parallel to the longitudinal axis of envelope 10 extending from a location near the top edge of front panel 12 to a point near the bottom edge of front panel 12. It will be understood and appreciated that the protrusions 18 may extend in any direction, such as transverse to the longitudinal axis of envelope 10, diagonal or any direction there between, so long as protrusions 18 are adapted to prevent the movement of an item contained within envelope 10 and protect the contents from external forces.

As best seen in FIG. 2, back panel 14 is made up of left and right panels 22, 24 that are coupled to the right and left edges of front panel 12 along fold lines 26, 28 respectively. It will be understood and appreciated that it is within the scope of this invention to form back panel 14 of one piece, such as in the booklet-styled envelope, or form back panel 14 in three or more pieces. As shown in FIG. 2, panels 22, 24 are rectangular-shaped and each are slightly greater than half the size of front panel 12, but it should be understood that each panel 22, 24 can be any size which allows them to be folded in and adhesively secured to form a back panel 14.

Protrusions 20 are coupled to the interior surfaces of right and left panels 22, 24 and are used in conjunction with protrusions 18 located on front panel 12 to reduce the amount of movement of an item located within the interior portion of envelope 10. The structure of protrusions 20 is similar to that of protrusions 18. Specifically, as best seen in FIGS. 2 and 3, protrusions 20 can be elongated beads of material that are coupled to the interior surface of panels 22, 24 and protrude outwardly from panels 22, 24 into an interior portion of envelope 10. Protrusions 20 are spaced apart from one another at a distance that will allow protrusions 20 to mesh or fit in between each of protrusions 18 when envelope 10 is constructed and panels 22, 24 are placed over front panel 12 as seen by dotted lines 30. Further, protrusions 20 generally extend in a direction that is parallel to the longitudinal axis of envelope 10, extending from a location near the top edge of each of the panels 22, 24 to a point near the bottom edge of panels 22, 24. It will be understood and appreciated that the protrusions 20 may extend in any direction, such as transverse to the longitudinal axis of envelope 10, diagonal or any direction there between, but protrusions 20 are preferably formed in a pattern similar to that of protrusions 18 so that protrusions 18, 20 will mesh with one another.

Protrusions 18, 20 are formed of any suitable material that will create some degree of protection from external forces, and will also grip to items or articles that are placed within the interior portion of envelope 10. In particular, protrusions 18, 20 are preferably formed of an adhesive material that is adapted to be fixedly coupled to the interior surfaces of front and back panels 12, 14 respectively. Once fixedly coupled to panels 12, 14, protrusions 18, 20 are adapted to dry or otherwise lose their adhesive qualities, and to grip and prevent the shifting of items container within envelope 10. This material may be formed of a hot melt material. It is also within the scope of the present invention to form protrusions 18, 20 from other types of materials such as, but not limited to, plastic, rubber, polymeric materials and other materials that can be fixedly coupled to panels 12, 14 and that have qualities that enable protrusions 18, 20 to limit the movement of items contained in envelope 10.

Protrusions 18, 20 may be used either singularly or in combination with one another to prevent movement of an item within the interior portion of envelope 10. The coupling of protrusions 18 or protrusions 20 to the interior surfaces of either one of the front or back panels 12, 14 may be sufficient to accomplish the objectives of the present invention. In addition, the present invention also contemplates the use of a single protrusion affixed to either the front or back panel 12, 14, operating singularly or in conjunction with one or more protrusion affixed to the opposite panel. Although it is preferred to use a number of protrusions 18, 20 on front and back panels 12, 14, it is not necessary to use a plurality of protrusions coupled to both the front and back panels 12, 14 to accomplish the functions of the present invention.

Alternatively, protrusions 18, 20 need not be elongated beads of material as depicted in FIG. 2. The elongated beads could instead be a series of spaced bars together forming relatively elongated segments of protrusions as best seen in FIG. 6. In addition, the elongated beads could be a series of dots as best seen in FIG. 7, or other relatively circular segments. The protrusions may be in any shape or size so long as the protrusions function to provide protection and prevent shifting of the contents within envelope 10. Further, the protrusions can be positioned in any suitable pattern, or randomly, along the interior surface of one or both of front and back panels 12, 14.

As best seen in FIG. 2, seal flap 16 is fixedly coupled to the top edge of front panel 12 along fold line 32. An attachment mechanism 34 is mounted near the top edge of seal flap 16. It is within the scope of this invention to include an attachment mechanism anywhere on seal flap 16 so long as flap 16 may be fastened to back panel 14 to retain an article or item within the interior portion of envelope 10. Attachment mechanism 34 may be in the form of an adhesive, such as a re-moistenable adhesive or an adhesive having a protective strip thereover (i.e., peel and seal adhesive), a mechanical fastener, a re-sealable assembly or the like. Although depicted in FIGS. 2, 6 and 7 as a pair of square adhesive portions, attachment mechanism 34 can be any suitable shape, including, but not limited to, a single, elongated strip of adhesive or more than two spaced adhesive portions.

The bottom edge of front panel 12 is fixedly coupled to a bottom flap 36 along fold line 38. An adhesive assembly 40 is fixedly coupled to and extends along the lower half of bottom flap 36. Adhesive assembly 40 is adapted to couple bottom flap 36 to the outside surface of back panel 14 to prevent items contained within envelope 10 from being removed from the bottom of envelope 10.

In assembling envelope 10 shown in FIGS. 1 and 2, the adhesive assembly 40 is fixedly mounted on bottom flap 36, and attachment mechanism 34 is coupled to seal flap 16. The elongated beads of material forming protrusions 18 are then applied to front panel 12 and extend outwardly from the interior surface of front panel 12 so protrusions 18 will extend into the interior portion of envelope 10. In particular, protrusions 18 are coupled to the interior surface of front panel 12 in a direction parallel to the longitudinal axis of envelope 10 and extend from a point near the top portion of front panel 12 towards the bottom edge of front panel 12. Protrusions 18 are applied parallel to each other and spaced apart so that protrusions 20 are capable of meshing or being positioned in alternating fashion between protrusions 18.

Protrusions 20 are coupled to left and right panels 22, 24 in the same fashion as protrusions 18 were coupled to front panel 12. The elongated beads of material forming protrusions 20 are applied to the interior surface of right and left panels 22, 24 and extend outwardly from the surface of panels 22, 24 so protrusions 20 will extend into the interior portion of envelope 10. In particular, protrusions 20 are coupled to the interior surface of panels 22, 24 in a direction parallel to the longitudinal axis of envelope 10 and extend from a point near the top portion of each of panels 22, 24 towards the bottom edge of panels 22, 24. Protrusions 20 on each of panels 22, 24 are applied parallel to each other and spaced apart so that protrusions 20 on panels 22, 24 are capable of meshing with protrusions 18.

Protrusions 18, 20 are preferably adhered to front and back panels 12, 14 by an extrusion system. Generally, when the beads of material are applied to front and back panels 12, 14, the material is injected with air or another type of gas. Thus, when the material cures, the protrusions 18, 20 lose their adhesive characteristics but still have a relatively soft and pliable texture to enable them to prevent the items from sliding around within envelope 10. One example of a machine that performs the extrusion function contemplated in the present invention is the FOAMMELT® extrusion system manufactured by NORDSON® Corporation, 300 Nordson Drive, Amherst, Ohio 44001. Depending on the type of material used to form protrusions 18, 20, the extrusion system may or may not be necessary to give protrusions 18, 20 gripping capabilities. Of course, protrusions 18, 20 can be formed by means other than an extrusion process. For example, segments of protrusion forming material having adhesive characteristics on one side thereof may be adhered to the interior surfaces of front and back panels 12, 14 by means of a roll or tape positioned above the surface of the envelope blank, thereby coupling protrusions 18, 20 to panels 12, 14.

Next, the left panel 22 is folded along fold line 26 and positioned on top of front panel 12. Right panel 24 is then folded along fold line 28 and on top of front panel 12. The edge of right panel 24 overlaps the edge of the left panel 22 and panels 22, 24 are then adhesively coupled to one another. Of course, it is understood that the order of folding the right and left panels 22, 24 can be reversed. Bottom flap 36 is folded along fold line 38 and on top of the bottom edges of the exterior surfaces of front and back panels 12, 14. Adhesive assembly 40 is then used to seal the bottom portion of envelope 10. Front and back panels 12, 14 now form an interior portion where items or articles may be placed therein. As best seen in FIGS. 2 and 4, protrusions 18, 20 are in mesh with one another after envelope 10 is formed.

In operation, protrusions 18, 20 are in mesh, or aligned in alternating fashion, prior to placing anything within envelope 10. As best seen in FIGS. 2 and 4, once an item, such as a piece of paper 39, is placed within interior portion of envelope 10, a portion of protrusions 18, 20 move apart from each other and are in contact with the item or article. The contact between protrusions 18, 20 and the item reduce or prevent the movement of the item or article within the interior portion of envelope 10. Minimizing the amount of movement of the item will prevent the item from being damaged due to shifting within the interior portion of envelope 10. As best seen in FIG. 5, if the size of an item 41 is small in comparison to the size of envelope 10, then a situation is created in which some protrusions 18, 20 are not in contact with item 41, in particular, those protrusions 18, 20 positioned around the edges of envelope 10. In those areas where protrusions 18, 20 are not in contact with item 41, protrusions 18, 20 can mesh and further prevent item 41 from moving or shifting into those areas of the envelope 10.

As is apparent, envelope 10 can operate in a suitable fashion when the protrusions comprise different numbers or shapes, positioned in different patterns or randomly on the panel surfaces, or are positioned on only one of the front or back panels 12, 14. For example, it is within the scope of this invention to position protrusions 18, 20 on the interior surfaces of panels 12, 14 so protrusions 18, 20 are aligned with one another when panels 12, 14 are folded on top of each other during the construction of envelope 10. Protrusions 18, 20 generally not mesh with one another but would still function to protect the items contained within the interior portion of the envelope from external forces, as well as reduce the shifting of the item contained in the interior portion of the envelope.

Once an item is placed in envelope 10 and protrusions 18, 20 prevent paper 39 or item 41 from shifting within the interior portion of envelope 10, seal flap 16 may be folded over and sealed to the exterior surface of back panel 14 by folding flap 16 along folding line 32. Attachment mechanism 34 may then be used to removably couple flap 16 to back panel 14 to retain paper 39 or item 41 within the interior portion of envelope 10.

In an alternative embodiment, envelope 10 includes perforations 18, 20 that are structured and operate the same as in the preferred embodiment, but envelope 10 further includes a handle that allows a user hold onto envelope 10. As best seen in FIG. 6, a weakened portion 42 such as a portion defined by perforations, is located in the center and toward the top edge of front panel 12. Weakened portion 42 forms part of the circumferential edge of a section 44. In particular, weakened portion 42 extends around the curved portions and along the lower edge of section 44. Seal flap 16 includes a weakened portion 52 that is formed generally in the center of flap 16. Weakened portion 52 extends around the curved portions and along the top edge of a section 54. An aperture 48 is formed in the upper left side of panel 22 and is sized and shaped to match the left portion of section 44. Further, an aperture 50 is formed in the upper right side of right panel 24 and is sized and shaped to match the right portion of section 44.

Weakened portions 42, 52 are capable of being broken so that sections 44, 54 can be punched out to form a handle and allow a user to hold onto envelope 10. Weakened portions 42, 52 are preferably a series of perforations, but it should be understood that any type of means for allowing sections 44, 54 to be broken away from front and back panels 12, 14 may be utilized. Sections 44, 54 may alternatively be square, rectangular, circular, or any suitable shape which functions in accordance with this invention, but are generally the same size and shape so they match up when positioned on top of one another. Sections 44, 54 may be fixedly coupled to front and back panels 12, 14 along fold lines 46, 56 to allow sections 44, 54 to remain coupled to envelope 10 even after weakened portions 42, 52 are broken. In operating this alternative embodiment, a user may hold onto envelope 10 by breaking weakened portions 42, 52 and pushing sections 44, 54 against the outer portion of front panel 12 to form a handle. In addition, sections 44, 54 may be resealed to protect the items in the envelope from the external environment during mailing.

Constructed and operated as previously described, this invention provides an envelope that protects an item contained within the envelope from being damaged from external forces during handling or mailing. In addition, the present invention provides for an envelope that reduces the amount of movement of an item contained within an interior portion of the envelope.

In summary, the present invention is directed to a packaging envelope, bag or other mailing device and a method for making the same. The present invention has been described in relation to particular embodiments which are intended in all respects to be illustrative rather than restrictive. Alternative embodiments will become apparent to those skilled in the art to which the present invention pertains without departing from its scope.

From the foregoing, it will be seen that this invention is one well-adapted to attain the ends and aspects hereinabove set forth together with other advantages which are obvious and inherent to the structure. It will be understood that certain features and subcombinations are of utility and may be employed without reference to other features and subcombinations. This is contemplated by and is within the scope of the claims.

Having thus described the invention, what is claimed is:

1. An envelope for packaging an article, said envelope comprising:

a front panel;

a back panel, said back panel coupled to said front panel to form an interior portion defined by opposed inner surfaces of said front and back panels;

means to selectively couple said front panel to said back panel to seal said interior portion of the envelope;

means for reducing the movement of the article within said interior portion of the envelope.

* * * * *